US008117800B2

(12) United States Patent
Lobson

(10) Patent No.: US 8,117,800 B2
(45) Date of Patent: Feb. 21, 2012

(54) METHOD AND ELEMENTS FOR FORMING A BUILDING FACADE

(76) Inventor: Craig Lobson, Winnipeg (CA)

( * ) Notice: Subject to any disclaimer, the term of this patent is extended or adjusted under 35 U.S.C. 154(b) by 136 days.

(21) Appl. No.: 12/105,962

(22) Filed: Apr. 18, 2008

(65) Prior Publication Data

US 2008/0216446 A1 Sep. 11, 2008

Related U.S. Application Data

(63) Continuation-in-part of application No. 11/221,690, filed on Sep. 9, 2005, now abandoned.

(51) Int. Cl.
*E04B 1/00* (2006.01)

(52) U.S. Cl. ..... 52/747.11; 52/747.12; 52/315; 52/596; 52/288.1

(58) Field of Classification Search ..... 52/384, 52/389, 314, 311.1, 315, 747.11, 747.12, 52/555, 596, 543, 288.1
See application file for complete search history.

(56) References Cited

U.S. PATENT DOCUMENTS

| | | | | | |
|---|---|---|---|---|---|
| 2,207,687 | A | | 7/1940 | Snyder | |
| 3,217,453 | A | | 11/1965 | Medow | |
| 3,350,827 | A | * | 11/1967 | Sugar | 52/309.3 |
| 3,518,799 | A | | 7/1970 | Bachner | |
| 3,544,416 | A | | 12/1970 | Gebhard, Jr. | |
| 3,552,987 | A | * | 1/1971 | Smith | 427/197 |
| 3,555,757 | A | | 1/1971 | Volent | |
| 3,701,228 | A | | 10/1972 | Taylor | |
| 3,762,113 | A | | 10/1973 | O'Mullan et al. | |
| 3,836,619 | A | | 9/1974 | Volent | |
| 3,968,610 | A | | 7/1976 | Medow | |
| 4,197,684 | A | | 4/1980 | Johnson | |
| 4,940,558 | A | | 7/1990 | Jarboe et al. | |
| 5,181,636 | A | * | 1/1993 | Anderson et al. | 222/389 |
| 5,328,730 | A | | 7/1994 | Lowe | |
| 5,395,577 | A | | 3/1995 | Gorski | |
| 5,543,185 | A | | 8/1996 | Christensen | |
| 5,713,561 | A | | 2/1998 | Sugoyama | |
| 5,720,423 | A | * | 2/1998 | Kondo et al. | 227/130 |
| 5,826,373 | A | | 10/1998 | Mrdjenovich | |
| 5,946,877 | A | | 9/1999 | Gallinat et al. | |
| 6,033,744 | A | | 3/2000 | Bright, Sr. | |
| 6,132,820 | A | * | 10/2000 | Callahan | 428/15 |
| 6,248,411 | B1 | | 6/2001 | Warfel | |
| 6,253,515 | B1 | | 7/2001 | Kuelker | |
| 6,408,585 | B1 | * | 6/2002 | Tajima | 52/506.06 |

(Continued)

FOREIGN PATENT DOCUMENTS

| | | |
|---|---|---|
| CA | 974726 | 9/1975 |

(Continued)

*Primary Examiner* — Robert Canfield
*Assistant Examiner* — Jessie Fonseca
(74) *Attorney, Agent, or Firm* — Ryan W. Dupuis; Kyle R. Satterthwaire; Ade & Company, Inc.

(57) ABSTRACT

A facade is formed on an upright supporting surface using a plurality of facade elements formed of plastic material having a flat rear side and a decorative front side protruding from the rear side. The flat rear side of the elements can be abutted directly against the upright supporting surface with the elements in spaced relation with one another and secured thereon using nails from an air driven nailer. Grouting in the form of mortar repair or caulking can be used to fill the gaps between adjacent elements on the supporting surface to complete the appearance of a natural stone facade on a building wall.

14 Claims, 3 Drawing Sheets

U.S. PATENT DOCUMENTS

| | | | | |
|---|---|---|---|---|
| 6,443,667 | B2 | 9/2002 | Brown | |
| 6,455,113 | B1 | 9/2002 | Bilodeau | |
| 6,726,864 | B2 * | 4/2004 | Nasr et al. | 264/46.4 |
| D502,281 | S | 2/2005 | Krause | |
| 6,944,998 | B1 | 9/2005 | King | |
| 2002/0092256 | A1 | 7/2002 | Hendrickson et al. | |
| 2003/0066259 | A1 | 4/2003 | Sudweeks | |
| 2005/0229527 | A1 | 10/2005 | Buchi | |

FOREIGN PATENT DOCUMENTS

| | | |
|---|---|---|
| CA | 2008052 | 7/1990 |
| CA | 2166364 | 7/1996 |

* cited by examiner

METHOD AND ELEMENTS FOR FORMING A BUILDING FACADE

This application is a continuation-in-part of U.S. parent application Ser. No. 11/221,690, filed Sep. 9, 2005, which is now abandoned.

FIELD OF THE INVENTION

The present invention relates to a facade element and a method of forming a building facade using a plurality of facade elements.

BACKGROUND

Stone foundations on buildings are known to have a desirable appearance. Due to the costly nature of forming a foundation of stone and the difficulties involved in retrofitting stone onto an existing building it is popular to make use of a facade to imitate that look of a stone foundation. Known facades generally involve use of flat stones or imitation stones made of plaster which are mounted on an upright supporting surface of the building using mortar and grout to hold the stones in place. In each instance, costly and skilled labour is typically required to achieve a desirable finished appearance.

Various imitation stones formed of plastic material are known in the prior art as shown in the following U.S. Pat. Nos. 4,940,558 to Jarboe et al.; 5,395,577 to Garski; 5,826,373 to Mrdjenovich; 6,248,411 to Krause; 4,197,684 to Johnson and D502,281 to Krause. None of the known prior art designs of imitation stones are suited for replacing stones in a stone building foundation though due to their size and configuration. Furthermore, no prior art configuration of facade elements is suitably arranged for quick mounting together with a proper finished appearance which closely resembles a foundation of stones set in mortar.

SUMMARY OF THE INVENTION

According to one aspect of the invention there is provided a method of forming a facade on an upright supporting surface, the method comprising:

forming a plurality of hollow facade elements of plastic material comprising a substantially flat rear side and a decorative front side protruding from the rear side such that the flat rear side and the decorative front side enclose a hollow interior therebetween;

abutting the rear side of the elements against the upright supporting surface with the elements in spaced relation with one another;

securing the elements to the upright supporting surface with nails by driving the nails through the front side of each element, across the hollow interior and into the rear side such that the nails are embedded through the rear side and into the supporting surface in a mounted position of the elements; and grouting between the elements.

The use of facade elements which are formed of plastic are low in cost and can be easily mounted on an upright supporting surface using nails by securing the elements directly to the supporting surface without any skilled masonry labour being required. Accordingly a proper finished appearance which closely resembles a foundation of stones set in mortar can be achieved without any specialty labour requirements to reduce installation cost in addition to the low material cost of the facade elements according to the present invention.

Preferably, the front side and the rear side of each element are integrally formed with one another in a common molding process. A preferred type of molding comprises rotational molding, however other types of molding, for example blow molding or thermoforming may also be suitable for integrally molding each element in a single molding operation.

When rotationally molding, preferably each element is formed in a common rotational mold comprising a vent and two mold portion joined at a seam with the seam being preferably located between the front side and the rear side of each element substantially in a common plane with the side of the element so as to minimize the appearance of seams in mounted positions in a finished facade. Similarly, the vent is preferably located in communication through the rear side of the element so as to be hidden from view in the mounted position.

One or more vent apertures may be provided in the rear side of each element for ventilating the hollow interior of the element and the supporting surface upon which it is mounted and to allow for drainage.

The method may further include orienting each element when the element is secured to the upright supporting surface such that one vent aperture of the element is located adjacent a bottom side of the element.

When driving the nails through the front and rear sides of the elements using an air driven nailer, a driving air pressure of the air driven nailer may be adjusted to penetrate the nails into the upright supporting surface to the degree desired by the user.

Preferably the nails are driven through the front side and the rear side of each element such that each nail spans at least partway across the hollow interior between the front side and the rear side of the element in the mounted position. Accordingly only a portion of each nail extends through the rear side and into the upright supporting surface in the mounted position.

The nails may also be driven into the elements so as to be oriented transversely to one another at differing orientations relative to the supporting surface.

Typically, the nails comprise nails of the type having a shaft and a low profile head at one end of the shaft in which the head has a cross-sectional dimension near to a cross-sectional dimension of the shaft so as to be penetrated through the front side of the elements with minimal disturbance to the material forming the front side of the elements about each penetration aperture in the elements.

In one embodiment, the nails are driven fully through the front side of the elements so as to be embedded only through the rear side and into the supporting surface in the mounted position. In this instance, the resilient nature of the material forming the front side of the elements causes the penetration apertures in the front side to at least partially close to best disguise the nails in the mounted position.

Alternatively, the nails may be driven through the front side of each element such that the nails remain embedded in the front side substantially flush with an outer surface of the front side. In this instance, the nails remain engaged with both front and rear sides of the elements while spanning the hollow interior therebetween for optimal strength in securing the elements to the supporting surface.

Preferably the front side of each element is formed of resilient material arranged to be resiliently deformed about the nails penetrated therethrough either for closing about a penetration aperture when the nails are driven fully through the front side or for being formed closely and in sealing engagement about a nail head when the nails are mounted flush in the front side of the elements.

When mounting elements on an upright supporting surface comprising a central portion spanning between two exterior corner edges, the method may also comprise: forming a plurality of corner elements of plastic material comprising a rear side having two flat panels oriented perpendicularly to one another to define an interior corner edge and a front side protruding from the rear side such that the rear side and the front side enclose a hollow interior therebetween; and mounting the corner elements on the supporting surface such that the interior corner edge of each corner element mates with the exterior corner edge of the supporting surface and one of the flat panels of each corner elements is abutted against the upright supporting surface. In this instance, the facade elements may be mounted on the central portion of upright supporting surface subsequent to mounting the corner elements on the upright supporting surface.

The supporting surface is preferably arranged to be more resistant to penetration of the nails than the elements so that the nails are easily penetrated into the elements while remaining only partially penetrated into the supporting surface.

When securing each element to the upright supporting surface, a first nail may be driven centrally into the element so that the element can be rotated about the first nail to re-orient the element relative to the supporting surface prior to subsequent nails being driven into the element to fix orientation of the element relative to the supporting surface.

The elements may be formed of a plastic material comprising a plurality of particles of differing colour which are integrally molded with one another. In this instance, arranging the particles to be near in dimension to a cross-sectional dimension of a head of the nails assists in disguising the nails in the mounted position.

Grouting between the elements may be accomplished using a mortar material which is arranged to be dispensed from a caulking tube.

BRIEF DESCRIPTION OF THE DRAWINGS

In the drawings like characters of reference indicate corresponding parts in the different figures.

DETAILED DESCRIPTION

Figure 1:
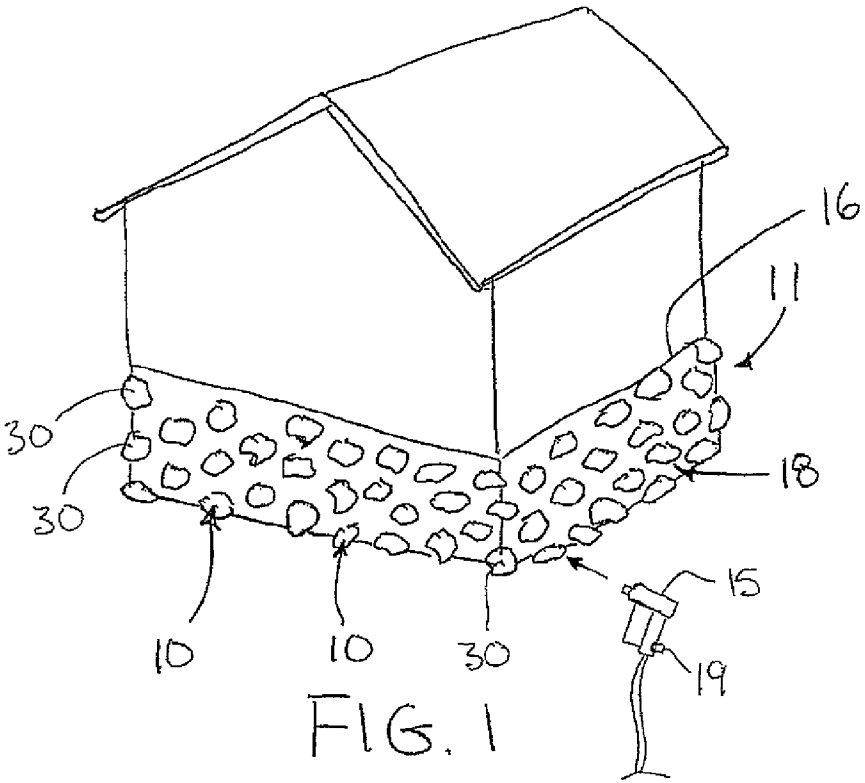
FIG. 1 is a perspective view of a building upon which the facade elements have been installed.

Referring to the accompanying figures there is illustrated a facade element generally indicated by reference numeral 10. The element 10 is used in cooperation with a plurality of other elements of similar configuration to form a building facade 11 which imitates and closely resembles the appearance of a natural stone or brick foundation set in mortar, but with low cost plastic material which can be installed without any skilled workers, for example masons, being required. Though various embodiments of the elements are described and illustrated in the following, the common feature of each will first be described herein.

In each instance the element 10 includes a body formed of plastic material, for example polyethylene, which is formed to include a substantially flat rear side 12 and a decorative front side 14 which is textured and which protrudes outwardly from a rear plane of the flat rear side 12. The plastic is formed so as to have sufficient strength to be rigid and self-supporting, yet will have sufficient resilience to prevent cracking when pierced with nails and the like during mounting of the elements on an upright supporting surface 16. The flat rear side 12 is to be configured to mount to the upright supporting surface 16 directly in abutment therewith.

Each element 10 is formed to be a hollow member in which the flat rear side 12 and the decorative front side 14, which protrudes from the rear side, are integrally formed together to fully surround and enclose the hollow interior 13 between the front and rear sides. The front side joins the rear side about a periphery of the rear side generally in a common plane therewith so that the front side, which is textured to resemble a stone in appearance, is domed outwardly relative to the rear side.

Figure 9:
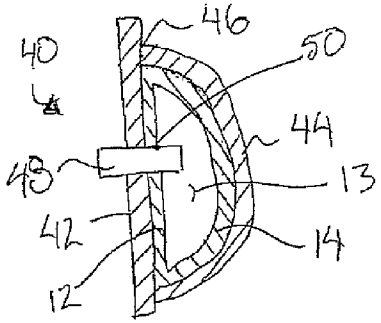
FIG. 9 is a cross sectional view of one of the facade elements in an exemplary rotational mold.

In a preferred method of forming the elements, the front and rear sides are integrally formed by rotational molding in a common mold 40 as shown in FIG. 9. As illustrated the rotational mold for molding each element comprises a rear mold portion 42 for forming the flat rear side of each element and a front portion 44 which forms the front side of the element. The two mold portions are joined together at a seam 46 lying generally in a common plane with the rear side of the element being formed. Accordingly the seam which may be visible on the molded element is hidden from view directly against the supporting surface upon which the element is mounted to be covered by grout so as not to be visible in the finished facade of elements 10.

Figure 7:
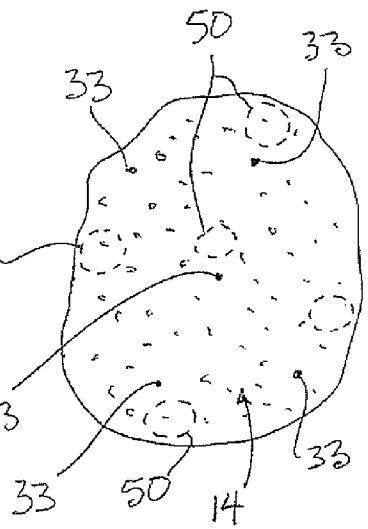
FIG. 7 is a front elevational view of one of the facade elements.

The rotational mold also includes a vent 48 which is communicated through the rear mold portion and accordingly through the rear side of the element being formed. In a preferred embodiment a plurality of the vents 48 are provided in communication with each element both centrally and about a periphery of the element as best shown in FIG. 7. When locating vent apertures 50 formed in the rear side of the element adjacent the outer periphery of the rear side, at least one of the vent apertures can be located adjacent the bottom side of the element in the mounted position when the rear side is mounted in an upright orientation on the supporting surface. This configuration allows for drainage of any water collected therein and to ventilate any moisture trapped within the hollow interior of the element or trapped against the supporting surface against which the element is supported.

The strength of the material forming the elements is typically selected to be softer than the supporting surface against which the elements are mounted such that there is more resistance to penetration of nails into the supporting surface than through the material of the front and rear sides of the element. In this manner nails can be driven through the front and rear sides of the element using a suitable air driven nailer 15 with the nails only being able to be partly penetrated into the supporting surface beneath the elements so as to remain engaged at least partway through the element in the mounted position thereof.

Typically the nails comprise finishing nails having a shaft 60 and a low profile head 62 formed at one end of the shaft, for example by pressing a portion of the shaft to be somewhat flattened. Accordingly the head of the nail has a dimension thereacross which is near a corresponding dimension of the shaft so as to not have a significantly greater resistance to penetration through the front side of the element than the shaft when penetrating nails through the elements with an air driven nailer. The plastic material forming the front side of the element is arranged to be sufficiently resilient so as to be resiliently deformed about the nails penetrated therethrough to assume the shape of the nail and be enclosed tightly and in sealing engagement fully about the head and the shaft of a nail driven through the element.

When mounting the elements to the supporting surface, the air pressure of the air nailer is controlled to penetrate the nails through the elements and into the upright supporting surface to the degree desired for effectively fixing the elements to the upright supporting surface. To optimally secure each element to the supporting surface, the nails are typically driven through the element and into the supporting surface at a plurality of different angular and directional orientations such that different nails secured to the same element extend outwardly from the supporting surface so as to be inclined either towards or away from one another generally within a range of 45° to 90° relative to the supporting surface. The nails securing each element are thus oriented transversely or non-parallel to one another and relative to the supporting surface at differing orientations.

In each method of installation according to either FIG. 3 or 6 described below, the nails are typically driven through both the front and rear sides of each element such that the nails span at least partway across the hollow interior between the front and rear sides in the mounted position of the element. Accordingly only a portion of each nail extends through the rear side and into the supporting surface in the mounted position such that a substantial portion of the nail remains spanning into the hollow interior of the element to resist the element being pulled away from the supporting surface to an optimal degree.

Figure 6:
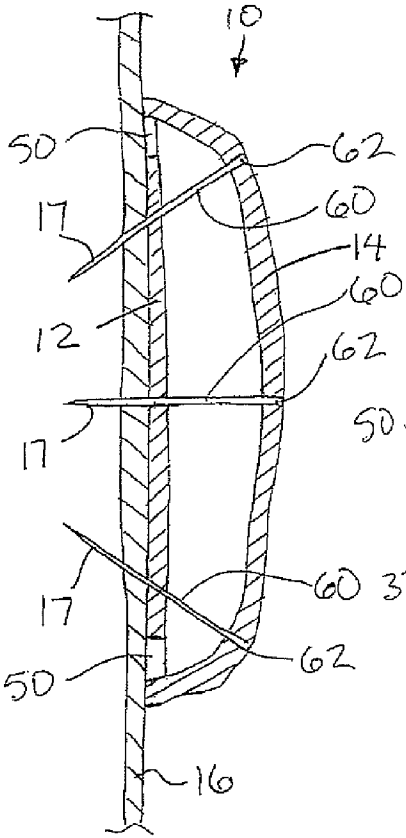
FIG. 6 is a sectional elevational view of a further method of installation of the facade element.

Penetrating the nails so that they remain engaged within both the front and rear sides of the elements as shown in FIG. 6 has the advantage of increased strength in mounting the elements to the supporting surface. Alternatively, fully penetrating the nails through the front side to be embedded only in the rear side in the mounted position, as shown in FIG. 3, has the advantage of the apertures 19 which receive the nails therethrough being partially closed due to the resilient nature of the material forming the elements for optimally hiding the nails used for mounting the elements to the supporting surface.

When mounting on the building, the flat rear panel is substantially abutted against the upright supporting surface by placing the rear side directly against and in contact with the supporting surface. Nails are used to secure the element in place. As described above, using an air driven nailer 15, nails 17 are inserted at the front side so as to be driven fully through the front side 14 then remain imbedded through the flat rear panel at the rear 12 and the supporting surface 16 for gripping the flat rear panel to the supporting surface. An air pressure control 19 may be used to control the air pressure and thus the depth of penetration of the nails 17 through the elements and into the supporting surface. Additional elements 10 are mounted in a similar manner in spaced apart relation with one another on the upright supporting surface. A grouting material 18 is then used to fill the gaps between adjacent elements. The grouting material typically comprises a conventional mortar or a caulking material, for example a mortar repair material or compound which is dispensed from a caulking tube.

Figure 2:
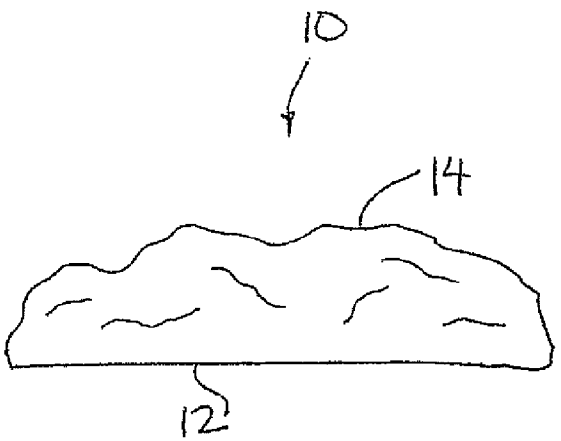
FIG. 2 is a side elevational view of a first embodiment of the facade element.
Figure 3:
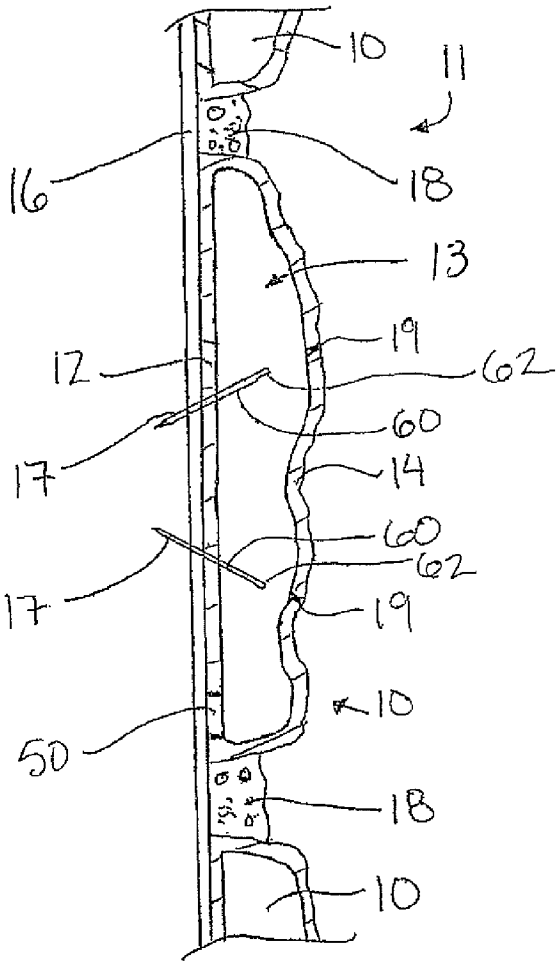
FIG. 3 is sectional view of the element according to FIG. 2 as shown installed on an upright supporting surface.

Turning now to FIGS. 2 and 3, a first embodiment is illustrated in which the element is fully enclosed about a hollow interior. The flat rear side 12 comprises an enclosed flat panel formed integrally with the front side 14 which comprises a domed surface having a stone like texture at the outer side thereof. In this arrangement, the air pressure of the nail gun is arranged such that the nails are shown driven fully through so as to be no longer in contact with the front side 14 of the element. In a finished mounted position, the nails span only partway across the hollow interior between the front and rear side to be embedded only through the rear side of the element and the supporting surface. As the nail is driven through the front side 14, apertures 19 are formed in the front side. The resilient nature of the material forming the element causes the apertures in the front side to at least partially close upon passage of the nail therethrough to reduce the appearance of the nail mounting locations.

Figure 5:
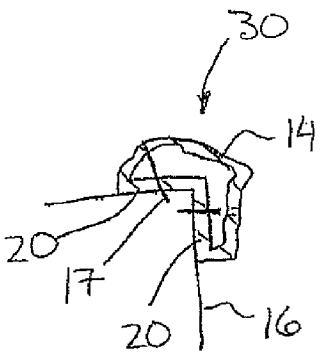
FIG. 5 is a partly sectional top plan view of the element according to FIG. 4.
Figure 4:
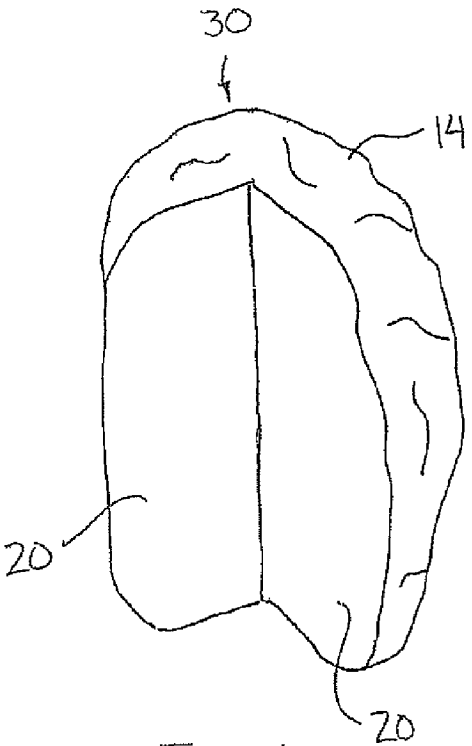
FIG. 4 is a perspective view of a corner facade element.

Turning now to FIGS. 4 and 5 a corner element 30 is illustrated which is formed similarly to the elements 10 for use together in covering an upright supporting surface including a central portion spanning between two exterior corner edges of a building. Each corner element comprises an enclosed element having a hollow interior. The rear side 12 comprises two flat panels 20 oriented perpendicularly to one another to define an interior corner edge which is arranged to overlap the exterior corner edge of the upright supporting surface 16 on the building. The front side 14 is similarly formed integrally with the rear side to form a domed surface with a stone texture which projects outwardly from the rear side to enclose the hollow interior of the element therebetween. Nails are similarly driven through the front side 14 for gripping the rear side 12 and being embedded into the supporting surface 16. When mounting on a wall, typically the corner elements can be first installed by mating the interior corner edge of the corner elements with the exterior corner edge of the surface and nailing the corner elements in place, followed by the remaining facade elements 10 being subsequently installed on the central portion of the supporting surface between the exterior corner edges of the building.

Turning now to FIG. 6, a further embodiment of the installation of the element 10 according to FIG. 3 is shown. As shown in FIG. 6, the air pressure of the nail gun is arranged such that the nails are driven through the front side of each element so as to remain embedded in the front side substantially flush with an outer surface of the front side. Accordingly, the nails fully span across the hollow interior of the element between both front and rear sides of the element which remain engaged with the nails in the mounted position. The resilient nature of the material deforms about the nail head penetrated therethrough so that the material of the element is sealed snugly and fully about the shape of the nail head embedded therein.

As further shown in FIG. 6, each element can be secured to the upright supporting surface by initially driving a first nail centrally into the element. Once only the first nail has been penetrated, the element can still be rotated about the first nail to re-orient the element relative to the supporting surface. Reorienting the elements is desirable for locating the vent apertures in the elements adjacent the bottom sides thereof and for aligning adjacent ones of the elements relative to one another such that the gaps between adjacent elements can be arranged to be consistent with one another. Once properly aligned, the elements can be fixed in orientation relative to the supporting surface by penetrating subsequent nails into the element.

Turning now to FIG. 7, the elements can be formed of plastic material comprising a plurality of particles of differing colour, for example plastic powder suitable as starting material in a rotation molding operation, which are arranged to be integrally molded with one another during the molding operation. The variation of particle colour contributes to a more realistic appearance of a stone, as well as having the additional benefit of disguising the nail heads 33 when flush mounted in the front side of the stone according to the method of installation of FIG. 6. Forming the particles to be near in dimension to a corresponding dimension across the heads 33 of the nails causes the nail heads to appear similar to the variation in the stone texture for a proper finished appearance without the nails being apparent in the mounted position even when flush mounted in the front side of the elements.

Figure 8:
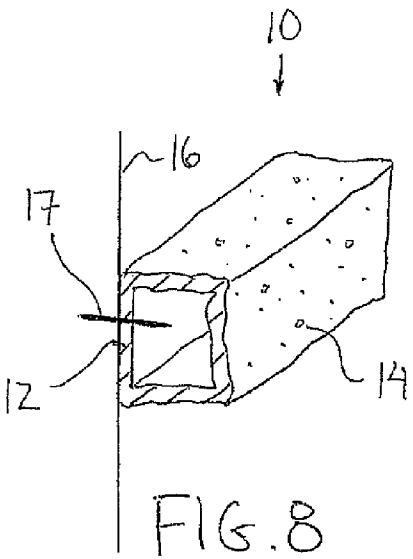
FIG. 8 is perspective view of another embodiment of the facade element.

Turning now to FIG. 8 a further embodiment of the element is illustrated in which the plastic formed body is fully enclosed with a hollow interior similarly to the first embodiment. The rear side is flat with the front side 14 being generally rectangular and protruding outwardly from the rear side to form a rectangular brick like shape. The front side 14 includes a masonry-like texture for resembling a conventional masonry brick. In order to mount the element to the wall, nails are similarly used to be driven fully through the front side 14 to be embedded in the rear side 12 and the upright supporting surface 16.

In further embodiments, the elements 10 may be secured by adhesive or other suitable fastening means which permit the rear side 12 to be abutted against the upright supporting surface upon which the building facade 12 is to be formed.

In all embodiments, a plurality of facade elements are formed of plastic material and are mounted with their rear sides in abutment with the upright supporting surface in spaced apart relationship with one another. Nails are typically provided for adequately securing the elements to the supporting surface. Once mounted on the supporting surface, a suitable caulking or grouting material 18 is used to fill the gaps between adjacent elements 10.

The facade elements can be formed by various manufacturing techniques including injection moulding, rotational moulding, blow moulding or thermoforming depending upon the desired characteristics of the finished elements.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method of forming a facade on an upright supporting surface, the method comprising:

providing a plurality of hollow facade elements, each formed of a resilient plastic body, the body of each element comprising:

a substantially flat rear side and a decorative front side protruding from the rear side such that the flat rear side and the decorative front side of the plastic body enclose a hollow interior therebetween;

wherein the flat rear side comprises a nail receiving portion and a plurality of vent apertures formed about a periphery of the element in the flat rear side such that the vent apertures in the flat rear side are the only apertures in the plastic body;

abutting the flat rear side of each element against the upright supporting surface such that the element is in spaced relation with other elements and such that all of the apertures in the plastic body are located in the flat rear side abutted with the supporting surface;

orienting each element such that at least one of the vent apertures in the flat rear side about the periphery of each element is located adjacent a bottom of the element in a mounted position of the element on the upright supporting surface;

securing each element to the upright supporting surface subsequent to abutting the flat rear side against the upright supporting surface by driving nails fully through the front side of each element, across the hollow interior and into the nail receiving portion of the flat rear side such that the nails are embedded through the rear side and into the supporting surface in the mounted position.

2. The method according to claim 1 including rotationally molding each element in a rotational mold comprising a vent and two mold portions joined at a seam, locating the seam between the front side and the rear side of each element, locating the vent of the mold in communication through the rear side of the element, and forming said at least one vent aperture with the vent of the mold.

3. The method according to claim 1 including driving the nails through the front and rear sides of the elements by using an air driven nailer and adjusting a driving air pressure of the air driven nailer to penetrate the nails into the upright supporting surface.

4. The method according to claim 1 including driving the nails through the front side and the rear side of each element such that each nail spans at least partway across the hollow interior between the front side and the rear side of the element in the mounted position.

5. The method according to claim 1 including driving the nails through the front side and the rear side of each element such that only a portion of each nail extends through the rear side and into the upright supporting surface in the mounted position.

6. The method according to claim 1 including driving a plurality of nails through each element such that the nails are oriented in non-parallel relation to one another at 45 degrees in orientation relative to the supporting surface.

7. The method according to claim 1 including arranging the nails to comprise nails having a shaft and a low profile head at one end of the shaft in which the head has a dimension thereacross which is near to a corresponding dimension of the shaft.

8. The method according to claim 1 including forming the front side of each element of material having a resiliency such that penetration apertures in the front side are arranged to at least partially close.

9. The method according to claim 1 for the upright supporting surface comprising a central portion spanning between two exterior corner edges, the method comprising:

forming a plurality of corner elements of plastic material comprising a rear side having two flat panels oriented perpendicularly to one another to define an interior corner edge and a front side protruding from the rear side such that the rear side and the front side enclose a hollow interior therebetween; and mounting the corner elements on the supporting surface such that the interior corner edge of each corner element mates with the exterior corner edge of the supporting surface and one of the flat panels of each corner elements is abutted against the upright supporting surface.

10. The method according to claim 9 including securing the facade elements on the central portion of the upright supporting surface subsequent to mounting the corner elements on the upright supporting surface.

11. The method according to claim 1 including arranging the supporting surface to be more resistant to penetration of the nails than the elements.

12. The method according to claim 1 including securing each element to the upright supporting surface by driving a first nail centrally into the element, rotating the element about the first nail to re-orient the element relative to the supporting surface and driving subsequent nails into the element to fix orientation of the element relative to the supporting surface.

13. The method according to claim 1 including grouting between the elements using a mortar material arranged to be dispensed from a caulking tube.

14. The method according to claim 1 including molding each element in a mold comprising two mold portions joined at a seam between the front side and the rear side of each element, locating the seam between the front side and the rear side of each element substantially in a common plane with the rear side of the element such that the seam is directly against the upright supporting surface, and grouting between the elements such that the seam of each element is covered by grout.

* * * * *